US010063037B2

(12) United States Patent
Tokumaru et al.

(10) Patent No.: US 10,063,037 B2
(45) Date of Patent: Aug. 28, 2018

(54) SPARK PLUG

(71) Applicant: NGK SPARK PLUG CO., LTD., Nagoya-shi, Aichi (JP)

(72) Inventors: Masaki Tokumaru, Komaki (JP); Kazuhiko Mori, Nisshin (JP); Kei Takahashi, Nagoya (JP); Hironobu Mizutani, Konan (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 63 days.

(21) Appl. No.: 15/399,958

(22) Filed: Jan. 6, 2017

(65) Prior Publication Data

US 2017/0201074 A1 Jul. 13, 2017

(30) Foreign Application Priority Data

Jan. 13, 2016 (JP) ..... 2016-004634
Nov. 10, 2016 (JP) ..... 2016-219409

(51) Int. Cl.
*H01T 13/39* (2006.01)
*H01T 13/32* (2006.01)

(52) U.S. Cl.
CPC ..... *H01T 13/39* (2013.01); *H01T 13/32* (2013.01)

(58) Field of Classification Search
CPC ..... H01T 13/39; H01T 13/32
See application file for complete search history.

(56) References Cited

U.S. PATENT DOCUMENTS 6,078,129 A * 6/2000 Gotou ..... H01T 21/02 313/141
6,528,929 B1 3/2003 Matsutani et al.
6,533,628 B1 3/2003 Matsutani
2002/0121849 A1 9/2002 Kanao et al.
2009/0051259 A1 2/2009 Yoshimoto
2010/0253203 A1 10/2010 Suzuki et al.
2013/0221832 A1 8/2013 Ishiguro et al.

FOREIGN PATENT DOCUMENTS

JP H11-3765 A 1/1999
JP 2001-15245 A 1/2001
JP 2005-150011 A 6/2005
JP 2006-269441 A 10/2006

OTHER PUBLICATIONS

European Patent Office, Extended European Search Report issued in corresponding Application No. 7151041.5, dated Jun. 20, 2017.
Japan Patent Office, Office Action (Notification of Reasons for Refusal) issued in corresponding Application No. 2016-219409, dated Jan. 25, 2018.

* cited by examiner

*Primary Examiner* — Kevin Quarterman
(74) *Attorney, Agent, or Firm* — Stites & Harbison, PLLC; Jeffrey A. Haeberlin; James R. Hayne

(57) ABSTRACT

A spark plug includes a central electrode and a noble metal tip, which are joined together with a fusion portion interposed therebetween. A tip-adjoining boundary of the fusion portion has a shape that curves convexly toward the fusion portion. A central-electrode-adjoining boundary of the fusion portion has a shape that curves convexly toward the central electrode. The outline of a portion of the fusion portion exposed to the outer surface has a shape that curves concavely into the inner side of the fusion portion.

2 Claims, 3 Drawing Sheets

SPARK PLUG

CROSS REFERENCE TO RELATED APPLICATION

The present invention claims priority to Japanese Patent Application No. 2016-004634 filed on Jan. 13, 2016 and Japanese Patent Application No. 2016-219409 filed on Nov. 10, 2016.

BACKGROUND OF THE INVENTION

Field of the Invention

The present invention relates to a spark plug.

Description of Related Art

Spark plugs have thus far been designed for internal combustion engines of apparatuses such as an automobile, a cogeneration system, and a gas transfer pump. Such spark plugs include a central electrode and a ground electrode, between which a spark discharge gap is interposed. The air-fuel mixture is ignited by a spark discharge in the spark discharge gap.

Development of highly efficient engines or maintenance-free engines requires life extension of such spark plugs, so that the spark plugs include a tip made of a noble metal such as an iridium (Ir) alloy at an opposing portion or a spark discharge portion of the central electrode, which faces the spark discharge gap.

Here, a noble metal tip (such as Ir alloy) and a central-electrode base material (such as Ni alloy) have a large difference in coefficient of thermal expansion. To prevent the tip from being separated due to thermal stress, a fusion layer having a coefficient of thermal expansion that is substantially in the middle between the coefficients of thermal expansion of the noble metal tip and the central electrode base material is formed by laser welding. The thermal stress is thus reduced to tightly connect the noble metal tip and the central electrode base material together. In addition, a known spark plug includes a fusion layer, whose dimensional relationships between, for example, a width and a tip height, are adjusted so that the spark plug includes a durable firing end while the noble metal tip and the central electrode base material are sufficiently tightly connected together (for example, PTL 1).

RELATED ART DOCUMENT

PTL 1 is Japanese Unexamined Patent Application Publication No. 2001-15245.

BRIEF SUMMARY OF THE INVENTION

The spark plug described in PTL 1 includes a durable firing end while the noble metal tip and the central electrode base material are sufficiently tightly connected together. The inventors' keen study, however, has found a room for improvement in durability of the firing end.

In view of the above circumstances, the invention aims to provide a spark plug including a more highly durable firing end while a central electrode and a noble metal tip are sufficiently tightly connected together.

The invention was made to solve at least part of the above-described problem and can be embodied in the following modes.

(1) According to an aspect of the invention, a spark plug includes a stick-shaped central electrode extending in an axial line direction (i.e., defining a longitudinal axis), a tube-shaped insulator that holds the central electrode on a distal side of the insulator, a tube-shaped metal shell disposed around the insulator, a ground electrode joined to a distal end portion of the metal shell, and a noble metal tip joined to a distal end portion of the central electrode and opposing an end portion of the ground electrode with a gap interposed therebetween. The central electrode and the noble metal tip are joined together with a fusion portion interposed therebetween, the fusion portion being obtained by fusing at least one component of the central electrode and at least one component of the noble metal tip. When viewed in a section including the axial line (i.e., longitudinal axis), a tip-adjoining boundary, which is a boundary between the noble metal tip and the fusion portion, has a shape that curves convexly toward the fusion portion within a range from a point X, located closest to a proximal end in the axial line direction (i.e., located substantially along the longitudinal axis closest to a proximal end of the central electrode), to an outer circumferential edge A. When viewed in the section including the axial line (i.e., longitudinal axis), a central-electrode-adjoining boundary, which is a boundary between the central electrode and the fusion portion, has a shape that curves convexly toward the central electrode within a range from a point Y, located closest to a distal end in the axial line direction (i.e., located substantially along the longitudinal axis closest to a distal end of the noble metal tip), to an outer circumferential edge B. When viewed in the section including the axial line (i.e., longitudinal axis), an outline of a portion of the fusion portion exposed to an outer surface (i.e., an outer surface of the fusion portion) has a shape that curves concavely into an inside of the fusion portion (i.e., toward the longitudinal axis). In the spark plug having this configuration, each of the tip-adjoining boundary, a boundary between the noble metal tip and the fusion portion, and the central-electrode-adjoining boundary, a boundary between the central electrode and the fusion portion, has a shape that curves convexly toward a member made of a material having a larger coefficient of thermal expansion. This configuration thus reduces a stress that occurs due to a difference in thermal expansion at each of the boundaries, whereby the noble metal tip and the central electrode are less likely to be separated from each other at each boundary. Since the tip-adjoining boundary, a boundary between the noble metal tip and the fusion portion, has a shape that curves convexly toward the fusion portion, the fusion portion is less likely to be exposed from the discharge surface of the noble metal tip after the discharge surface is worn by spark discharge. Thus, this configuration has higher durability. In addition, the outline of the portion of the fusion portion exposed to the outer surface has a shape that curves concavely into the inner side of the fusion portion. Thus, the fusion portion can be prevented from being subjected to discharge.

(2) In the spark plug having the above-described configuration, when viewed in the section including the axial line (i.e., longitudinal axis), a farthest point of the tip-adjoining boundary within the range from the point X, located closest to the proximal end in the axial line direction, to the outer circumferential edge A is located to an outer side of a reference position in a radial direction, the reference position being located to a side further inward from an outer circumferential surface of the noble metal tip by a quarter of an outer diameter of the noble metal tip, the farthest point being located farthest from a straight line passing the point X and the outer circumferential edge A. This configuration renders the fusion portion further less likely to be exposed from the discharge surface of the noble metal tip after the discharge surface is worn by spark discharge. Thus, this configuration has much higher durability.

BRIEF DESCRIPTION OF THE DRAWINGS

Illustrative aspects of the invention will be described in detail with reference to the following figures wherein.

DETAILED DESCRIPTION OF THE PREFERRED EMBODIMENTS OF THE INVENTION

A. Embodiments

A-1. Configuration of Spark Plug

Figure 1:
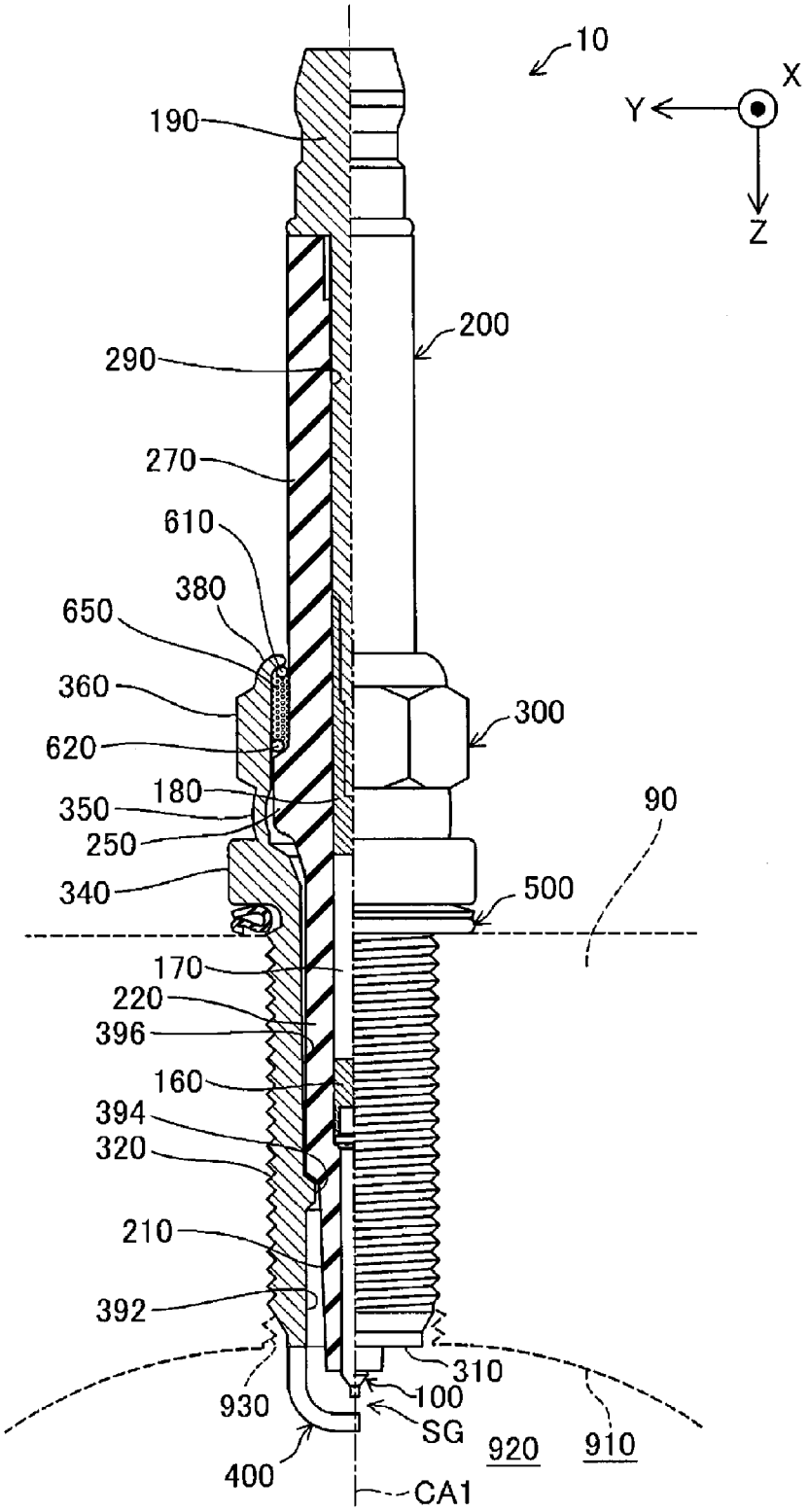
FIG. 1 is a partially sectional view of a spark plug.

FIG. 1 is a partially sectional view of a spark plug 10. FIG. 1 illustrates an external appearance of the spark plug 10 on the right side of FIG. 1 with respect to an axial line CA1, which is an axis of the spark plug 10, and a section of the spark plug 10 on the left side of FIG. 1 with respect to the axial line CA1. A lower side of the spark plug 10 in FIG. 1 is referred to as "a distal side" and an upper side of the spark plug 10 in FIG. 1 is referred to as "a proximal side".

The spark plug 10 includes a central electrode 100, an insulator 200, a metal shell 300, and a ground electrode 400. In this embodiment, the axial line CA1 of the spark plug 10 also functions as the axes of the central electrode 100, the insulator 200, and the metal shell 300.

The spark plug 10 has a gap SG at a distal portion between the central electrode 100 and the ground electrode 400. The gap SG of the spark plug 10 is also referred to as a spark gap. The spark plug 10 is attachable to an internal combustion engine 90 such that its distal portion at which the gap SG is disposed protrudes beyond an internal wall 910 of a combustion chamber 920. When a high voltage is applied to the central electrode 100 while the spark plug 10 is attached to the internal combustion engine 90, a spark discharge occurs in the gap SG. The spark discharge that has occurred in the gap SG can ignite the air-fuel mixture inside the combustion chamber 920.

FIG. 1 illustrates X, Y, and Z axes, which are perpendicular to one another. Among the X, Y, and Z axes illustrated in FIG. 1, the axis parallel to the axial line CA1 is represented as the Z axis. Among Z axis directions parallel to the Z axis (axial line directions), the direction from the proximal side toward the distal side of the spark plug 10 is represented as a +Z axis direction and the opposite to the +Z axis direction is represented as a −Z axis direction. The +Z axis direction is the direction in which the central electrode 100 protrudes from the distal end of the metal shell 300 along the axial line CA1 together with the insulator 200.

Among the X, Y, and Z axes illustrated in FIG. 1, the axis parallel to the direction in which the ground electrode 400 extends after being bent toward the axial line CA1 is represented as a Y axis. Among Y axis directions parallel to the Y axis, the direction in which the ground electrode 400 extends after being bent toward the axial line CA1 is represented as a −Y axis direction and the opposite to the −Y axis direction is represented as a +Y axis direction.

Among the X, Y, and Z axes illustrated in FIG. 1, the axis perpendicular to the Y axis and the Z axis is represented as an X axis. Among X axis directions parallel to the X axis, the direction from the far side toward the near side of FIG. 1 is represented as a +X axis direction and the direction opposite to the +X axis direction is represented as a −X axis direction.

The central electrode 100 of the spark plug 10 is an electrically conductive electrode. The central electrode 100 has a stick shape extending while having the axial line CA1 at the center. In this embodiment, the central electrode 100 is made of a nickel alloy (such as Inconel, registered trade mark) mainly composed of nickel (Ni). The distal side of the central electrode 100 protrudes from the distal side of the insulator 200. The central electrode 100 is electrically connected to a metal terminal 190, with a sealant 160, a ceramic resistor 170, and a sealant 180 interposed therebetween.

A noble metal tip 110 is joined to a distal portion of the central electrode 100 with a fusion portion 120 interposed therebetween, the fusion portion 120 being obtained by fusing the components of the central electrode 100 and the components of the noble metal tip 110.

The ground electrode 400 of the spark plug 10 is an electrically conductive electrode. In this embodiment, the ground electrode 400 has a shape that extends from the metal shell 300 parallel to the axial line CA1 and is then bent toward the axial line CA1. The proximal portion of the ground electrode 400 is joined to the metal shell 300. The distal portion of the ground electrode 400 and the central electrode 100 form a gap SG between themselves. In this embodiment, the ground electrode 400 is made of a nickel alloy (such as Inconel, registered trade mark) mainly composed of nickel (Ni).

The insulator 200 of the spark plug 10 is a ceramic insulator having electric insulation. The insulator 200 has a tube shape extending while having the axial line CA1 at the center. In this embodiment, the insulator 200 is formed by firing an insulating ceramic material (such as alumina).

The insulator 200 has an axial hole 290, which is a through hole extending while having the axial line CA1 at the center. The central electrode 100 is held on the axial line CA1 inside the axial hole 290 of the insulator 200 while protruding from the distal side of the insulator 200 (in the +Z axis direction). The insulator 200 includes, on its outer side, a first tube-shaped portion 210, a second tube-shaped portion 220, a third tube-shaped portion 250, and a fourth tube-shaped portion 270 in order from the distal side toward the proximal end.

The first tube-shaped portion 210 of the insulator 200 is a cylindrical tube-shaped portion that tapers toward the distal side. The distal side of the first tube-shaped portion 210 protrudes from the distal side of the metal shell 300. The second tube-shaped portion 220 of the insulator 200 is a cylindrical tube-shaped portion having a diameter larger than the diameter of the first tube-shaped portion 210. The third tube-shaped portion 250 of the insulator 200 is a cylindrical tube-shaped portion that expands further outward beyond the outer circumference of the second tube-shaped portion 220 and the fourth tube-shaped portion 270. The fourth tube-shaped portion 270 of the insulator 200 is a cylindrical tube-shaped portion extending from the third tube-shaped portion 250 toward the proximal end. The proximal side of the fourth tube-shaped portion 270 protrudes from the proximal end of the metal shell 300.

The metal shell 300 of the spark plug 10 is a metal member having electric conductivity. The metal shell 300 has a tube shape extending while having the axial line CA1 at the center. In this embodiment, the metal shell 300 is a metal member obtained by plating, with nickel, a low-carbon steel member having a tube shape. In another embodiment, the metal shell 300 may be a metal member plated with zinc or a metal member not subjected to plating (plating-free metal member).

The insulator 200 is held inside the metal shell 300 while protruding from the distal side of the metal shell 300 (in the +Z axis direction) together with the central electrode 100. The metal shell 300 includes, on its inner side, a shell inner circumferential surface 392, a ring-shaped ridge 394, and a shell inner circumferential surface 396 in order from the distal side toward the proximal end.

The shell inner circumferential surface 392 of the metal shell 300 is located at a portion of the inner circumferential surface of the metal shell 300 that is closer to the distal end than the ring-shaped ridge 394 is. The ring-shaped ridge 394 of the metal shell 300 is a ring-shaped portion protruding inward from the shell inner circumferential surface 392 and the shell inner circumferential surface 396, which are inner circumferential surfaces of the metal shell 300. The shell inner circumferential surface 396 of the metal shell 300 is a portion of the inner circumferential surface of the metal shell 300 located closer to the proximal end than the ring-shaped ridge 394 is.

A gap between the shell inner circumferential surface 392 and the insulator 200 is larger than a gap between the ring-shaped ridge 394 and the insulator 200 or a gap between the shell inner circumferential surface 396 and the insulator 200. When the insulator 200 is inserted into the metal shell 300 from the proximal side so as to be installed in the metal shell 300, the ring-shaped ridge 394 and the shell inner circumferential surface 396 are used to fix the position of the insulator 200 with respect to the metal shell 300.

The metal shell 300 is fixed to the outer surface of the insulator 200 by crimping while being electrically insulated from the central electrode 100. The metal shell 300 includes, on its outer side, a distal end portion 310, a screw portion 320, a trunk portion 340, a groove 350, a tool engagement portion 360, and a crimped cover 380 in order from the distal side to the proximal side.

The distal end portion 310 of the metal shell 300 is a cylindrical tube-shaped portion forming a distal side of the metal shell 300 (a portion located in the +Z axis direction). The ground electrode 400 is joined to the distal end portion 310. The insulator 200 protrudes in the +Z axis direction together with the central electrode 100 from the center of the distal end portion 310.

The screw portion 320 of the metal shell 300 is a cylindrical tube-shaped portion having a threaded outer surface. In this embodiment, the spark plug 10 is attachable to the internal combustion engine 90 by screwing the screw portion 320 of the metal shell 300 into a screw hole 930 of the internal combustion engine 90. In this embodiment, the nominal diameter of the screw portion 320 is M12. In other embodiments, the nominal diameter of the screw portion 320 may be smaller (such as M8, M9, or M10) or larger (such as M14 or M18) than M12.

The trunk portion 340 of the metal shell 300 is a flanged portion expanding further outward beyond the outer circumference of the groove 350. In the state where the spark plug 10 is attached to the internal combustion engine 90, a gasket 500 is compressed between the trunk portion 340 and the internal combustion engine 90.

The groove 350 of the metal shell 300 is disposed between the trunk portion 340 and the tool engagement portion 360. The groove 350 is a cylindrical tube-shaped portion that has bulged further outward beyond the outer circumference when the metal shell 300 is fixed to the insulator 200 by crimping.

The tool engagement portion 360 of the metal shell 300 is a flanged portion expanding further outward beyond the outer circumference of the groove 350 into a polygonal shape. The tool engagement portion 360 has a shape that is engageable with a tool (not illustrated) used for attaching the spark plug 10 to the internal combustion engine 90. In this embodiment, the external shape of the tool engagement portion 360 is hexagonal.

The crimped cover 380 of the metal shell 300 is a proximal portion of the metal shell 300 that is shaped by being bent toward the insulator 200 when the metal shell 300 is fixed to the insulator 200 by crimping.

A ring member 610 is disposed on the proximal side of and a ring member 620 is disposed on the distal side of a space between the outer surface of the third tube-shaped portion 250 and the fourth tube-shaped portion 270 of the insulator 200 and the inner surface of the tool engagement portion 360 and the crimped cover 380 of the metal shell 300. The space between the ring member 610 and the ring member 620 is filled with powder 650. The ring members 610 and 620 are ring-shaped members made of metal (such as iron (Fe)). The powder 650 is powder for sealing (for example, talcum powder or talc).

The ring members 610 and 620 and the powder 650 seal the space between the insulator 200 and the metal shell 300 and allow the metal shell 300 to hold the insulator 200 more reliably. The ring members 610 and 620, which are ring-shaped members, may have an O shape without any cut in the circumferential direction or a C shape having a cut at any portion in the circumferential direction when viewed in a section perpendicular to the axial line CA1.

Figure 2:
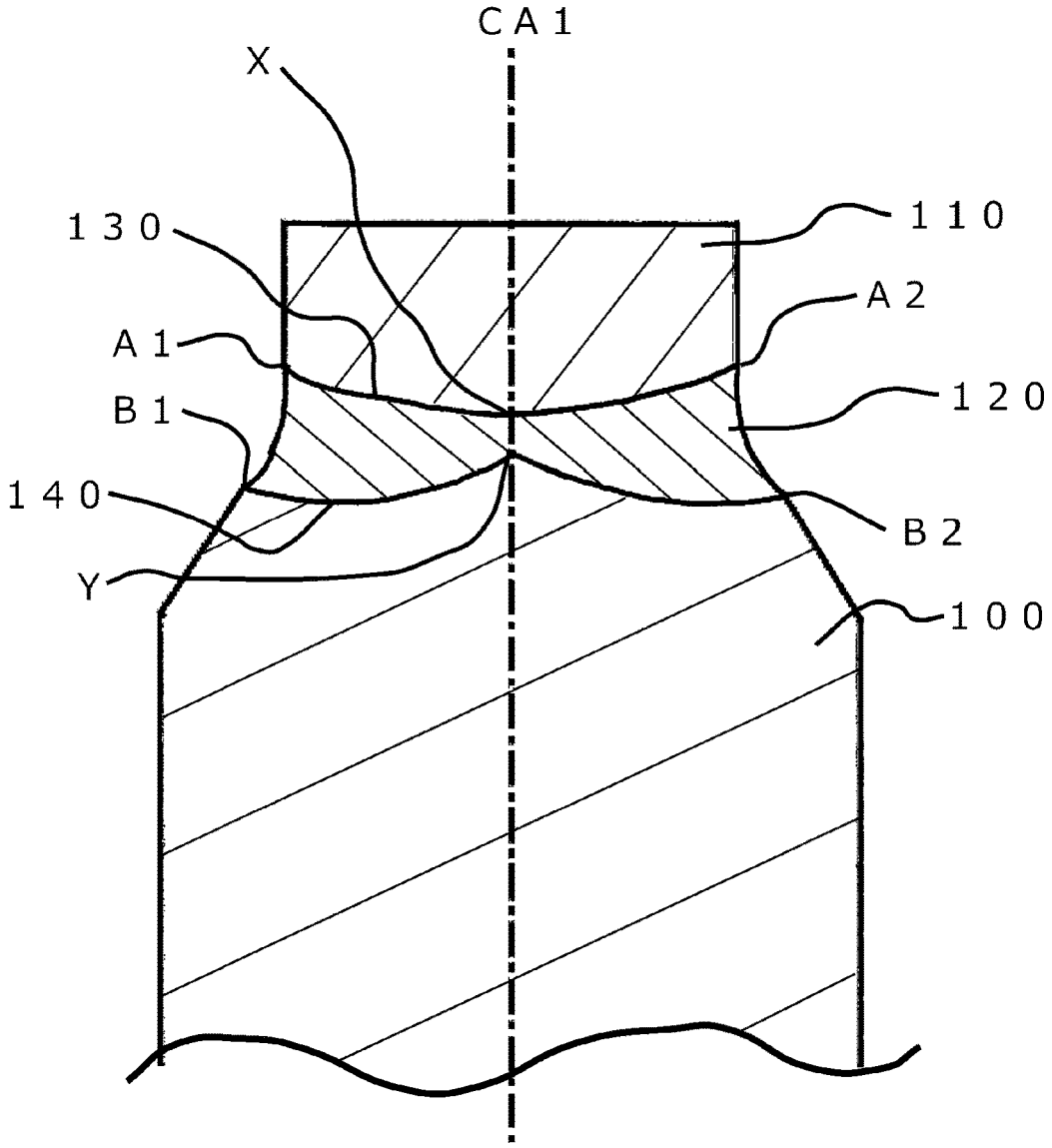
FIG. 2 is an enlarged sectional view of a main portion of the spark plug.

FIG. 2 is an enlarged sectional view of a portion around the distal end portion of the central electrode 100 to which the noble metal tip 110 is joined and including the axial line CA1. The lower side of FIG. 2 is expressed as "a proximal side" and the upper side of FIG. 2 is expressed as "a distal side".

As illustrated in FIG. 2, the noble metal tip 110 is joined to the distal end portion of the central electrode 100 with the fusion portion 120 interposed therebetween, the fusion portion 120 being obtained by fusing the components of the central electrode 100 and the components of the noble metal tip 110. When the noble metal tip 110 is disposed at the distal end portion of the central electrode 100 and the boundary between the noble metal tip 110 and the central electrode 100 is subjected to laser welding, the fusion portion 120 in which the components of the central electrode 100 and the components of the noble metal tip 110 are fused together is formed. Thus, the noble metal tip 110 and the central electrode 100 are joined together.

A tip-adjoining boundary 130, which is a boundary between the noble metal tip 110 and the fusion portion 120, has a shape that curves convexly toward the fusion portion 120 within a range from a point X, located closest to the proximal end in the direction of the axial line CA1, to an outer circumferential edge A1 and from the point X to an outer circumferential edge A2. Here, the outer circumferential edges A1 and A2 correspond to an outer circumferential edge A in the scope of claims. Here, the expression that "the tip-adjoining boundary 130 has a shape that curves convexly toward the fusion portion 120" means that the tip-adjoining boundary 130 within the range from the point X to the outer circumferential edge A1 is located at a portion closer to the proximal end than a virtual straight line connecting the point X to the outer circumferential edge A1. The tip-adjoining boundary 130 within the range from the point X to the outer circumferential edge A2 is also located similarly.

A central-electrode-adjoining boundary 140, which is a boundary between the central electrode 100 and the fusion portion 120, has a shape that curves convexly toward the central electrode 100 within a range from a point Y, located closest to the distal end in the direction of the axial line CA1, to an outer circumferential edge B1 and from the point Y to an outer circumferential edge B2. Here, the outer circumferential edges B1 and B2 correspond to an outer circumferential edge B in the scope of claims. Here, the expression that "the central-electrode-adjoining boundary 140 has a shape that curves convexly toward the central electrode 100" means that the central-electrode-adjoining boundary 140 within the range from the point Y to the outer circumferential edge B1 is located to a portion closer to the proximal end than a virtual straight line connecting the point Y to the outer circumferential edge B1. The central-electrode-adjoining boundary 140 within the range from the point Y to the outer circumferential edge B2 is also located similarly.

A portion of the fusion portion 120 exposed to the outer surface has a shape that curves concavely into the inner side of the fusion portion 120. Specifically, the outer surface of the fusion portion 120 is recessed. In FIG. 2, which is a sectional view including the axial line CA1, the outline of the portion of the fusion portion 120 exposed to the outer surface has a shape that curves concavely into the inner side of the fusion portion.

Figure 3:
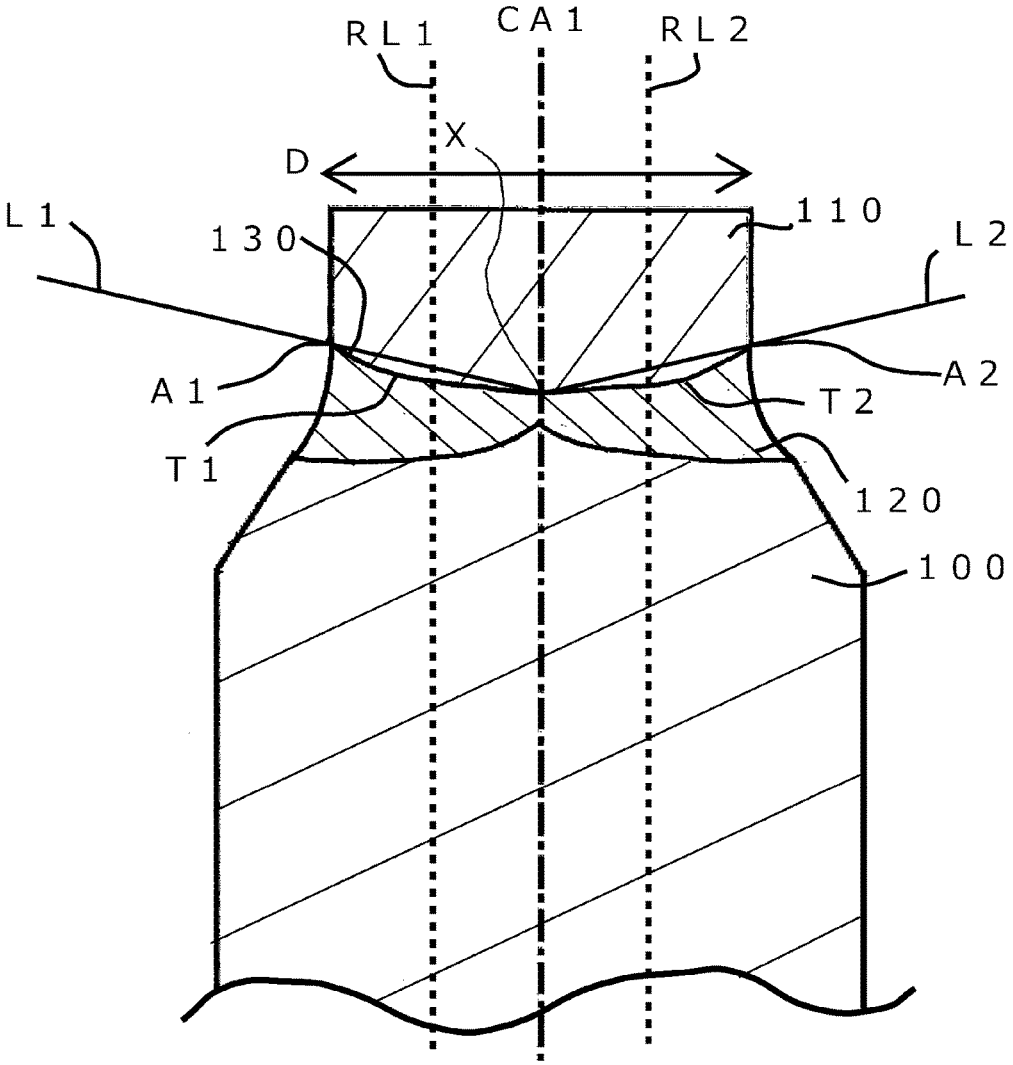
FIG. 3 is an enlarged sectional view of a main portion of the spark plug.

As in the case of FIG. 2, FIG. 3 is an enlarged sectional view of a portion around the distal end portion of the central electrode 100 to which the noble metal tip 110 is joined and including the axial line CA1. The lower side of FIG. 3 is expressed as "a proximal side" and the upper side of FIG. 3 is expressed as "a distal side".

FIG. 3 illustrates, for example, reference straight lines for easy specification of a preferable shape of the fusion portion 120. A straight line L1 is a straight line that passes the point X and the outer circumferential edge A1. A straight line L2 is a straight line that passes the point X and the outer circumferential edge A2. A straight line RL1 is a straight line parallel to the axial line CA1 and passing a portion located to the side further inward from the outer circumferential surface of the noble metal tip 110 by a quarter of the outer diameter D of the noble metal tip 110. A line RL2 is a straight line parallel to the axial line CA1 and passing a portion located to the side further inward from the outer circumferential surface of the noble metal tip 110 by a quarter of the outer diameter D of the noble metal tip 110.

As illustrated in FIG. 3, a farthest point T1 of the tip-adjoining boundary 130 within the range from the point X to the outer circumferential edge A1, which is farthest from the straight line L1, is located on the outer side of the straight line RL1 in the radial direction. Similarly, a farthest point T2 of the tip-adjoining boundary 130 within the range from the point X to the outer circumferential edge A2, which is farthest from the straight line L2, is located on the outer side of the straight line RL2 in the radial direction. The points of the convex tip-adjoining boundary 130 that are located farthest from the corresponding straight lines are located on the relatively outer side in the radial direction. This configuration renders the fusion portion 120 less likely to be exposed from the discharge surface as a result of a volume reduction of the noble metal tip 110 due to spark-caused wear than in the case where points of the convex tip-adjoining boundary 130 farthest from the corresponding straight lines are located to the relatively inner side in the radial direction. Specifically, this configuration has higher durability. In some cases, part of the fusion portion 120 extends up to and adheres to the outer circumferential surface of the noble metal tip 110 during laser welding. In such cases, a point of contact between the fusion portion 120 and the distal end point of the outer circumferential edge of the noble metal tip 110 is regarded as the outer circumferential edge A (A1 or A2). For example, in the case where the noble metal tip 110 has a uniform outer diameter, a point of contact between the fusion portion 120 and the distal end point of a portion of the noble metal tip 110 having a uniform outer diameter is regarded as the outer circumferential edge A (A1 or A2).

A-2. Effects

In the above-described embodiment, the tip-adjoining boundary 130, which is a boundary between the noble metal tip 110 and the fusion portion 120, has a shape that curves convexly toward the fusion portion 120 within the range from the point X, located closest to the proximal end in the direction of the axial line CA1, to the outer circumferential edge A1 and from the point X to the outer circumferential edge A2. Specifically, the tip-adjoining boundary 130 has a shape that curves convexly toward the fusion portion 120 having a large coefficient of thermal expansion. This configuration thus reduces a stress resulting from the difference in thermal expansion at the boundary between the noble metal tip 110 and the fusion portion 120. Thus, the central electrode 100 and the noble metal tip 110 are rendered less likely to be separated from each other at the boundary between the noble metal tip 110 and the fusion portion 120.

The tip-adjoining boundary 130, which is a boundary between the noble metal tip 110 and the fusion portion 120, has a shape that curves convexly toward the fusion portion 120 within the range from the point X, located closest to the proximal end in the direction of the axial line CA1, to the outer circumferential edge A1 and from the point X to the outer circumferential edge A2. This configuration renders the fusion portion 120 less likely to be exposed from the discharge surface of the noble metal tip 110 after the discharge surface wears due to spark discharge. This configuration thus has higher durability.

In addition, the central-electrode-adjoining boundary 140, which is a boundary between the central electrode 100 and the fusion portion 120, has a shape that curves convexly toward the central electrode 100 within a range from the point Y, located closest to the distal end in the direction of the axial line CA1, to the outer circumferential edge B1 and from the point Y to the outer circumferential edge B2. Specifically, the central-electrode-adjoining boundary 140 has a shape that curves convexly toward the central electrode 100 having a large coefficient of thermal expansion. This configuration thus reduces a stress resulting from the difference in thermal expansion at the boundary between the central electrode 100 and the fusion portion 120. Thus, the central electrode 100 and the noble metal tip 110 are rendered less likely to be separated from each other at the boundary between the central electrode 100 and the fusion portion 120.

The portion of the fusion portion 120 exposed to the outer surface has a shape that curves concavely into the inner side of the fusion portion 120. Specifically, the outer surface of the fusion portion 120 is recessed. In FIG. 2, which is a sectional view including the axial line CA1, the outline of the portion of the fusion portion 120 exposed to the outer surface has a shape that curves concavely into the inner side of the fusion portion 120. Thus, the fusion portion 120 can be prevented from being subjected to discharge. The fusion portion 120 is thus prevented from being abnormally worn by discharge.

In addition, the points of the convex tip-adjoining boundary 130 that are located farthest from the corresponding straight lines are located on the relatively outer side in the radial direction. This configuration renders the fusion portion 120 less likely to be exposed from the discharge surface as a result of a volume reduction of the noble metal tip 110 due to spark-caused wear than in the case where points of the convex tip-adjoining boundary 130 farthest from the corresponding straight lines are located to the relatively inner side in the radial direction. Thus, this configuration has higher durability.

B. Other Embodiments

The present invention is not limited to the above-described embodiments, examples, or modification examples and may be embodied in any of various different forms within the scope not departing from the gist of the invention. For example, the technical features of the embodiments, examples, or modification examples corresponding to the technical features of each embodiment described in Summary of the invention may be appropriately replaced with others or combined together in order to solve part of or all of the above-described problems or in order to achieve part of or all of the above-described effects. The technical features may be appropriately deleted unless the technical features are described as being essential herein.

DESCRIPTION OF REFERENCE NUMERALS

10: spark plug
90: internal combustion engine
100: central electrode
110: noble metal tip
120: fusion portion
130: tip-adjoining boundary
140: central-electrode-adjoining boundary
160: sealant
170: ceramic resistor
180: sealant
190: metal terminal
200: insulator
210: first tube-shaped portion
220: second tube-shaped portion
250: third tube-shaped portion
270: fourth tube-shaped portion
290: axial hole
300: metal shell
310: distal end portion
320: screw portion
340: trunk portion
350: groove
360: tool engagement portion
380: crimped cover
392: shell inner circumferential surface
394: ring-shaped ridge
396: shell inner circumferential surface
400: ground electrode
500: gasket
610: ring member
620: ring member
650: powder
910: internal wall
920: combustion chamber
930: screw hole
SG: gap
CA1: axial line
A (A1, A2): outer circumferential edge of tip-adjoining boundary
B (B1, B2): outer circumferential edge of central-electrode-adjoining boundary
X: point of tip-adjoining boundary located closest to the proximal end
Y: point of central-electrode-adjoining boundary located closest to the distal end
L (L1, L2): straight line passing point X and outer circumferential edge A (A1, A2)
T: point of tip-adjoining boundary farthest from straight line L
D: outer diameter of noble metal tip
RL (RL1, RL2): straight line passing a portion located inward from outer circumferential surface of noble metal tip by quarter of outer diameter of noble metal tip

What is claimed is:

1. A spark plug comprising:

a central electrode defining a longitudinal axis and including a distal end portion and a proximal end;

an insulator having a tubular shape and including a distal side, the insulator holding the central electrode on the distal side thereof;

a metal shell having a tubular shape, including a distal end portion, and disposed around the insulator;

a ground electrode including an end portion and joined to the distal end portion of the metal shell; and a noble metal tip including a distal end and being joined to the distal end portion of the central electrode and opposing the end portion of the ground electrode, the noble metal tip and the ground electrode defining a gap interposed therebetween, wherein the central electrode and the noble metal tip are joined together with a fusion portion interposed therebetween such that a space is formed between the entirety of the central electrode and the entirety of the noble metal tip and the fusion portion entirely fills the space between the central electrode and the noble metal tip, the fusion portion being obtained by fusing at least one component of the central electrode and at least one component of the noble metal tip, wherein, when viewed in a section including the longitudinal axis, a tip-adjoining boundary between the noble metal tip and the fusion portion has a shape that curves convexly toward the fusion portion within a range from a point X, located substantially along the longitudinal axis closest to the proximal end of the central electrode, to an outer circumferential edge A, wherein, when viewed in the section including the longitudinal axis, a central-electrode-adjoining boundary between the central electrode and the fusion portion has a shape that curves convexly toward the central electrode within a range from a point Y, located substantially along the longitudinal axis closest to the distal end of the noble metal tip, to an outer circumferential edge B, and wherein, when viewed in the section including the longitudinal axis, an outer surface of the fusion portion has a shape that curves concavely toward the longitudinal axis.

2. The spark plug according to claim 1, wherein, when viewed in the section including the longitudinal axis, a farthest point of the tip-adjoining boundary within the range from the point X to the outer circumferential edge A is located to an outer side of a reference position in a radial direction, the reference position being located to a side further inward from an outer circumferential surface of the noble metal tip by a quarter of an outer diameter of the noble metal tip, the farthest point being located farthest from a straight line passing the point X and the outer circumferential edge A.

* * * * *